United States Patent [19]

Elsen et al.

[11] Patent Number: 4,869,950

[45] Date of Patent: Sep. 26, 1989

[54] NONWOVEN FIBROUS BATT

[75] Inventors: Jeffrey M. Elsen; Martin F. Debney; Thomas J. Kling, all of Midland, Mich.

[73] Assignee: The Dow Chemical Company, Midland, Mich.

[21] Appl. No.: 96,413

[22] Filed: Sep. 14, 1987

[51] Int. Cl.[4] ..... B32B 27/14

[52] U.S. Cl. ..... 428/198; 428/283; 428/288; 428/327; 428/360

[58] Field of Search ..... 428/198, 283, 327, 360, 428/288

[56] References Cited

U.S. PATENT DOCUMENTS 4,050,977 9/1977 Buck et al. ..... 428/283

4,051,294 9/1977 Buck et al. ..... 428/283

*Primary Examiner*—James J. Bell

*Attorney, Agent, or Firm*—J. Robert Dean, Jr.; Thomas D. Zindrick; Bruce M. Kanuck

[57] ABSTRACT

A nonwoven fibrous batt which is formed by a dry process. The batt is formed by contacting any suitable fiber with an interpolymer of vinylidene chloride and an alkyl acrylate or an alkyl methacrylate. The batt may be formed into a variety of articles.

10 Claims, No Drawings

NONWOVEN FIBROUS BATT

FIELD OF THE INVENTION

The present invention relates to a novel bonding agent and a process for producing a nonwoven fiber web by a dry method using said bonding agent. More specifically, the present invention relates to using an interpolymer of vinylidene chloride and an alkyl acrylate or alkyl methacrylate as a binding agent in a nonwoven fiber web.

BACKGROUND OF THE INVENTION

Fabrics may be divided into two general groupings, woven and nonwoven. Woven fabrics may be considered to be any fabric including knitted fabrics in which substantially continuous lengths of fibers, filaments or yarns are connected in a generally regular arrangement or pattern. Woven fabrics are usually characterized by good hand and drape characteristics resulting from mobility of the fiber structure. Also, woven fabrics have good strength and dimensional stability. In contrast, nonwoven fabrics are generally in the form of batt or mat of randomly arranged filaments or fibers, usually of short length, bonded or held together. Nonwoven fabrics are distinguished by a flat sheet-like appearance with a tendency toward boardiness of hand and/or relatively poor strength. The principal advantage of nonwovens is lower cost. This is due to the fact that in the preparation of woven fabrics, it is necessary to spin and twist fibers into yarns; and weave, knit or braid the yarns into fabrics. Because of the lower cost of nonwovens, there has been considerable work to produce a fabric which has a lower cost of nonwoven fabrics while achieving the properties of woven fabrics. The fibers in web form are bonded together, for example, by the application of an adhesive binder or by mechanically compressing the fibers into contact with one another. The binder is selected to give good bonding to a variety of different fibers so that uniform bonding throughout the batt will be achieved.

There are essentially two methods for producing a nonwoven fiber batt, a dry method and a wet method. With the wet method, there is, just as in the production of paper, an emulsion produced which consists of a liquor and fibers which are disposed crossways from which the emulsion and liquor is removed by a force of gravity and by means of suction pumps with subsequent drying units. The wet web producing method features high production speeds and a great uniformity of the web, which consists of crossways lying fibers, but on the other hand it necessitates very power consuming subsequent drying processes and apparatus.

Completely dry processes for forming nonwoven fibrous batts are known and are described in the prior art. The dry method consists of applying a powdery or granular bonding agent or melting film or bonding agents to the web. These bonding agents are then melted with a heating unit and subsequently rehardened so that the web fibers stick together. This method is advantageous because the drying process can be omitted.

The particle size of the copolymer, its method of application to the fibrous web, and the subsequent heating and cooling of the batt all contribute to the strength, resiliency and durability of the batt. The resultant batt, in which fibers are typically bonded to each other at points of contact, possesses properties of lost, lightweight, and resilience which are distinctly superior to those of batts made by other processes.

Some years ago a method was developed for producing a fibrous batt by contacting a thin web of fibers with a bonding agent based on copolymers of vinylidene chloride and vinyl chloride (PVDC-PVC). The process is described in U.S. Pat. Nos. 3,993,518; 4,047,991; 4,050,977; 4,051,294; 4,053,673; and 4,053,674. The PVDC-PVC copolymer has adhesive and melt-flow properties which make it superior to all of the resins known at the time of the referenced invention. The PVDC-PVC copolymer is employed in dry particulate form, thus avoiding the packing and matting which is caused by using polymers in solution, suspension or emulsion form, and at the same time eliminating the cost of removing a solvent or aqueous carrier with heat.

While the PVDC-PVC copolymer has the important advantages cited above, it would be advantageous to provide a copolymer with all the above advantages and the additional advantages of having increased durability to withstand mechanical abuse, particularly during production steps, as well as increased softness for its end-use application.

It is therefore an object of the present invention to provide an improved binding material, which can withstand elevated temperatures for extended periods of time.

A still further object is to provide an improved fibrous batt. Additional objects and advantages of the present invention will be apparent to those skilled in the art by reference to the following detailed description and drawings.

SUMMARY OF THE INVENTION

These benefits and other advantages are achieved in accordance with the present invention. In one aspect the present invention is a fibrous batt comprising: (a) individual fibers and an at least partially melted bonding agent, wherein the fibers are present in an amount of from about 1 to about 95 percent by weight of batt and the bonding agent is present in an amount of from about 99 to about 5 percent by weight of batt; (b) said fibers being bonded at their intersection by melted particles of a bonding agent; (c) said bonding agent comprising (i) a vinylidene chloride interpolymer, the interpolymer being formed from a monomer mixture comprising vinylidene chloride in an amount of from about 70 to about 98 percent, based on total weight of monomer mixture, and (ii) at least one monoethylenically unsaturated monomer copolymerizable therewith in an amount of from about 30 to about 2 percent, based on total weight of monomer mixture, wherein the monoethylenically unsaturated monomer is selected from the group consisting of alkyl acrylates or alkyl methacrylates.

DETAILED DESCRIPTION

The fibers useful to produce the thin web can be from any source. Conventionally, webs made from a dry process are generally thin, usually only from 1 to 200 and preferably from 1 to 100 fibers thick.

Fibers useful to produce the thin web can be from any source including mixtures of different types of fibers. Exemplary fibers include natural fibers such as wood pulp fibers, cotton, linen, jute, kapok, wool, hair, and silk; and synthetic fibers such as cellulose fibers of the type of cellulose hydrate, cellulose derivatives such as cellulose esters, mixed cellulose esters, cellulose ethers, mixed cellulose ester-ethers, mixed cellulose ethers, cellulose hydroxy-ethers, cellulose carboxy-ethers, cellulose ether xanthates, cellulose xantho-fatty acids, cellulose thiourethanes; natural and synthetic rubber and derivatives thereof; fibers made of alginic acids, gelatine, casein; and mineral fibers such as, for example, spun glass, asbestos, mineral wool and the like; and fibers made of natural and synthetic resins which would be of such type that they are not rendered tacky when the bonding agent is rendered tacky; also fibers are filaments made by slitting, cutting, or shredding nonfibrrous films such as cellophane. Preferred fibers include those of polypropylene, nylon, acrylics, modacrylics, polyesters, cotton or blends thereof. The most preferred fibers useful to produce the fibrous batts are cotton fibers, which can be cotton obtained from any source.

For the purposes of this invention, it is understood that the term "vinylidene chloride interpolymer" encompasses both copolymer and interpolymers of vinylidene chloride.

The vinylidene chloride interpolymers are suitably formed from a monomer mixture comprising vinylidene chloride in an amount of from about 70 to about 98 percent, preferably from about 85 to about 97 percent, and most preferably from about 90 to about 96 percent of the total monomer mixture. Those monomers which are suitably selected for polymerization, in a predetermined amount, with the vinylidene chloride monomer are monoethylenically unsaturated monomers selected from the group consisting of alkylacryates or alkylmethacrylates. Suitable alkyl acrylates and alkyl methacrylates are those selected to have from about 1 to about 8 carbon atoms per alkyl group. The preferred alkyl acrylates and alkyl methacrylates have from about 1 to about 4 carbon atoms per alkyl group. Most preferably the alkyl acrylates and alkyl methacrylates are selected from the group consisting of methyl acrylate, ethyl acrylate, methyl methacrylate, n-butyl acrylate, isobutyl acrylate, sec-butyl acrylate, and 2-ethylhexyl acrylate.

Methods of forming the vinylidene chloride interpolymer suitable for use in the present invention are well-known in the prior art. The vinylidene chloride interpolymer is generally formed through an emulsion or suspension polymerization process. Exemplary of such processes are U.S. Pat. Nos. 2,558,728; 3,007,903; 3,642,743; 3,879,359; and the methods described by R. A. Wessling, in *Polyvinylidene Chloride,* Gordon breach Science Publishers, New York, 1977, Chapter 3. Typically, the monomeric materials are emulsified or suspended in an aqueous phase. In the emulsion process, the aqueous phase contains a polymerization initiator and a surface active agent capable of emulsifying the monomeric materials. The emulsion is then coagulated. In the suspension process, the monomer phase contains the polymerization initiator and the surface active agent capable of suspending the monomeric materials. The polymerizations of the monomeric materials are usually initiated with heat, and carried out with temperature control and agitation. The polymer is then dried to form a powder.

Generally, the monoethylenically unsaturated monomer will be present in an amount of from about 30 to about 2 percent by weight of the interpolymer, preferably from about 3 to about 15 percent by weight of the interpolymer, and most preferably from about 4 to about 10 percent by weight of the interpolymer.

The interpolymer is applied to the web in an amount sufficient to function as an adhesive. The vinylidene chloride interpolymer will be present in an amount of from about 99 to about 5 percent by weight of batt and the amount of fiber is from about 1 to about 95 percent by weight of batt; preferably in an amount of from about 50 to about 8 percent by weight of batt and the amount of fiber is from about 50 to about 92 percent by weight of batt; and most preferably in an amount of from about 30 to about 11 percent by weight of batt and the amount of fiber is from about 70 to about 89 percent by weight of batt.

The interpolymer particles generally have a size range of from about 1 to about 200 and preferably from about 5 to about 50 microns. Smaller powder sizes are useful technologically but are expensive to produce by conventional comminution processes. Larger sizes not only unnecessarily increase the weight of the resultant batt but also reduce the number of crosslinks of fibers possible with the given weight of interpolymer, which reduces bonding efficiency and strength. Interpolymers useful in the present invention have a sticking point of from about 110° C. to about 190° C.

After the interpolymer is contacted with the web, the web is formed into a batt. The batt, formed as described above, is then heated to a temperature above the sticking point of the interpolymer but below the melting point of the fiber, or substantially most fibers in a mixture. Generally, the batt is heated in a temperature range of about 100° C. to about 200° C. and preferably at a range of about 150° C. to about 190° C.

At much lower temperatures, the interpolymer does not melt, whereas at higher temperatures, a substantial portion of the fibers are adversely affected. The heating is conducted for a time sufficient to effect the desired melting of the interpolymer which generally occurs within a period of from about 1 to about 30 minutes. The batt is then cooled in air whereupon the melted interpolymer is resolidified. As the resin cools, it tends to crystallize.

Although not intended to be bound by theory, it is believed that the improved physical properties exhibited by the fiber web of this invention result from a different rate of crystallization of the vinylidene chloride interpolymers employed in the present invention. The VDC-MA interpolymer generally crystallizes more slowly than VDC-VC interpolymers. This rate of crystallization, as it applies to vinylidene chloride pellets utilized in rigid barrier containers, is disclosed in New Saran* Copolymers; TAPPI, Polymers, Laminations, and Coatings Conference; Sept. 16–17, 1986. (*Trademark of The Dow Chemical Company).

Depending upon the level of comonomers, vinylidene chloride interpolymers have varying proportions of amorphous and crystalline phases. Crystallinity values depend upon the measuring technique, and as used herein crystallinity is defined by the commonly used density method. See, for example, the discussion by R. Wessling, in chapter 6 of *Polyvinylidene Chloride,* volume V, Borden and Breach Science Publishers, New York, 1977, the teachings of which are incorporated herein by reference.

At VDC-MA and VDC-VC compositions selected to have equivalent melting temperatures, the VDC-MA interpolymer is in a generally more amorphous state at the same point of processing as the VDC-VC interpolymer. The VDC-VC interpolymer will have formed more highly crystallized between the bonds between the fibers than will VDC-MA interpolymer at similar points of the fabrication process; this is particularly critical before the web is fabricated into its end use product. The smaller amount of crystallization of the VDC-MA yields a web with improved texture, i.e., a web having improved resiliency and durability to physical handling.

At VDC-MA and VDC-VC compositions selected to have equivalent melting temperatures, the VDC-MA interpolymer will eventually obtain the same general level of crystallization as the VDC-VC interpolymer, but at a more advantageous time in the process. The benefit of increased texture at the batt-forming stage is that end-products made of batting according to the present invention will possess improved physical properties. Generally, after the batt is formed, it is rolled into a bale in which form it is conveniently stored and transported to end-product fabricators. Rolling the web into a bale, as well as subjecting it to subsequent fabrication methods, tends to break a portion of those already-formed physical bonds created by crystallization of the binder. Breaking the mechanical bonds yields a web having decreased tensile strength.

As a result of the differences in crystallization, proportionally more VCD-VC interpolymer than VDC-MA interpolymer is required in order to obtain the same tensile strength in the web. Consequently, for webs selected to have the same tensile strength, the fiber web containing VDC-MA interpolymer will contain less binder and will be softer than conventionally made fiber webs.

The method of forming the batt is according to techniques well known in the art. One method which performs satisfactorily involves contacting the fibers with the resin after the fibers have been opened and loosened from a compressed bale form, and at a stage when they are entrained in an air stream and prior to being deposited on a screen or in an off-take slot of an air-lay system producing nonwoven batts. U.S. Pat. No. 3,765,971 to Fleissner, hereby incorporated by reference, teaches an airlay method for producing a fibrous batt. The process generally comprises applying a bonding agent in a web mixing unit or a dosing unit, said bonding agent being in the form of a powdery granular fibrous or possibly liquid substance. Subsequently, a web is formed in an essentially known way, i.e. by means of at least one carding or blowing unit. The web which has already its final form is then bonded in a bonding unit and, if necessary, dried. The bonding unit comprises means on which the fiber web is uniformly heated by hot air. Means known in the art include belts or, as disclosed in the patent, several perforated drums which are arranged behind each other. The application of hot air to the fiber web causes the rapid bonding of the web which is then wound up on a batching device. Air-lay systems of this type are well known in the trade under the names Shirp, Rando Web, DOA, and others.

A garnetting process suitable for use in the present invention is disclosed in U.S. Pat. No. 4,051,294 to Buck, Jr. et al., issued Sept. 27, 1977. Generally, the garnett process comprises providing a machine having an inlet chute adapted to feed bulk fibers to a rotating drum and a plurality of tooth rolls which together with the rotating drum take the bulk fibers and convert them into a web which adheres to the drum. The web adhering to the drum is transferred to a second drum where it is removed by a comb. The web that is now only between 1 and 100 fibers thick and is barely self-supporting drops to a conveyor where it passes under a particle dispenser. While on the conveyor and supported thereby, the web is contacted with bonding agent which falls from a particle dispenser under the influence of gravity. In a manner well known in the art, the lower end of the conveyor is attached to a traveller which moves back and forth on a track. The conveyor is positioned above and at right angles to a second conveyor. The apparatus is adjusted such that the speed of the first conveyor is several times faster than the speed of the second conveyor. By virtue of this arrangement, the web is cross-laid back and forth on the conveyor thus forming an unheat-treated batt. In this process the batt is formed by lapping the thin polymer-containing web upon itself on a moving conveyor until the desired weight of batt is obtained. The unheat-treated batt passes between an upper foraminous belt and a lower foraminous belt. While held between the belts, the unheat-treated batt passes into an oven. After the fibrous batt is subjected to heating at a temperature above the melting point of the binder, it is subsequently cooled to a temperature below the melting point of the binder, wherein a web is formed into a desired thickness.

After formation of the web, the products may be compacted if it is desired to produce a web of increased density, and the compacting may be effected in any suitable manner as by pressing, squeezing, and tensioning. Also, the fibrous batt may be passed between pressure rolls to compress the mixed fibers, or it may be subjected to tension in either one or both directions. The properties of the finished product depend upon various factors, including the nature and proportion of the bonded fibers present in the product, the time and temperature used to activate the bonding agent, and whether or not the product is compacted by pressure and the like. All such factors may be preselected and controlled for the production of products of any degree of pliability, firmness, density or porosity, as may be desired.

The invention includes fibrous sheet materials having a wide range of properties. The web-forming material from which the fibrous batt is formed, in addition to the fibers, may contain added agents for obtaining special effects. For example, the fiber-forming material may contain dies, pigments, mothproofing agents, fireproofing agents, waterproofing agents, and the like.

Fibrous batting according to the present invention may be made into a variety of articles. Exemplary articles produced with a fibrous batt of this invention include upholstery padding, packing material, stuffed and shaped articles such as toys, construction materials such as wallboards, soundproofing material, and insulating material, as well as other articles. Methods for producing such articles are well known in the art.

The invention may be understood by reference to the following non-limiting examples. These examples are designed to teach those skilled in the art how to practice the invention and represent the best mode contemplated for practicing the invention. Unless otherwise specified, all parts and percentages are by weight.

EXAMPLE 1

A nonwoven fabric is prepared by using the adherent polymer of the present invention as the binding agent for a nonwoven web of shoddy fibers reclaimed from garments. The binder is present in an amount of 20 weight percent and the shoddy fiber is present in an amount of 80 weight percent, both weights based on the total weight of the resultant batt.

The adherent polymer used in this example is a copolymer of vinylidene chloride and methylacrylate in a weight ratio of 91.8 to 8.2. The copolymer has a melting temperature of about 150° C., a weight average molecular weight of 85,000, and a particle diameter (volume median diameter) of 30 microns.

As stated above, the fibrous web is prepared using shoddy fibers. The shoddy fibers used in this example consist primarily of cotton and polyester fibers. because of the source of the fibers, it is difficult to obtain an exact compositional breakdown, but the proportion of fibers is estimated to be about 60% polyester, about 40% cotton, and up to 1% acrylics. The length of fibers used is generally between about 25.4–50.8 mm.

The web components are dry blended to form a visually uniform admixture. Blending is accomplished by placing the components in a bag and then shaking and kneading them. More sophisticated equipment may be used but is not necessary.

The admixture is heated by a convection air oven, commercially available from Blue-M Electric Co, Blue Island, IL. The oven temperature is 175° C. The residence time in the oven is about 20 minutes. After the initial residence time, the batt is folded upon itself and placed in the oven for an additional 10 minutes at 175° C.

A batt of about 24 mm is obtained in which the fibers are firmly bonded together by the bonding agent. The resultant batt is tested to determine its texture after being at room temperature for 6 hours and is conditioned at 50% relative humidity. Specimens are tested on a Texture Analyzer model TA, commercially available from Voland-Stevens-LFRA, Hawthorne, N.Y. The machine is fitted with a standard 25.4 mm diameter, cylindrical flat-bottomed probe. The Analyzer is operated at a 2 mm/sec penetration speed, and a penetration distance of 50% of the batt. After reaching the penetration distance, the probe is held for approximately 30 seconds.

The results of the texture properties' tests are given in the table below.

EXAMPLE 2

The procedure of Example 1 is repeated except that the binder is present in an amount of 33 weight percent and the shoddy fiber is present in an amount of 67 weight percent, both weights based on the total weight of the resultant batt.

The results of the texture properties' tests are given in the table below.

EXAMPLE 3 the procedure of Example 1 is repeated except that the shoddy fibers in the batt (1) are on the average, about 3.2–6.4 mm shorter than the fibers used in Example 1; and (2) additionally consist of coatings and starches applied to the original garments from which the shoddy fiber is made.

The results of the texture properties' tests are given in the table below.

EXAMPLE 4

The procedure of Example 3 is repeated except that, after the initial 20 minute residence time in the oven, the batt is not compressed and not replaced in the oven.

The results of the texture properties' tests are given in the table below.

TABLE

| Example | Composition | Components[3] (%) | Batt Formation | Texture (g) |
|---|---|---|---|---|
| 1 | (1) VDC-MA[1]<br>(2) fiber[2] | (1) 20<br>(2) 80 | Compressed | 339 |
| 2 | (1) VDC-MA[1]<br>(2) fiber[2] | (1) 33<br>(2) 67 | Compressed | 334 |
| 3 | (1) VDC-MA[1]<br>(2) fiber[3] | (1) 20<br>(2) 80 | Compressed | 118 |
| 4 | (1) VDC-MA[1]<br>(2) fiber[3] | (1) 20<br>(2) 80 | Not Compressed | 425 |

[1]A copolymer of 91.5 weight percent vinylidene chloride and 8.5 weight percent methyl acrylate; and having a weight average molecular weight of 85,000, and having a particle size of 30 microns.

[2]A shoddy fiber, the proportion of fibers being estimated to be about 60% polyester, about 40% cotton, and up to 1% acrylics. The length of fibers used is generally between about 1–2 inches.

[3]A fiber made of the shoddy fibers in the batt (1) are, on the average, about 3.2–6.4 mm shorter than the fibers used in Example 1; and (2) additionally consist of coatings and starches applied to the original garments from which the shoddy fiber is made.

[4]Weight percent of vinylidene chloride interpolymer based on total weight of the composition.

[5]Texture in g at 50% compression using a Voland-Stevens-LFR Texture Analyzer, with a standard 25.4 mm diameter, cylindrical flat-bottomed probe.

As can be seen in the above table batts made according to this invention have excellent texture properties, and consequently have excellent resiliency for downstream production.

EXAMPLE 5

A nonwoven web is prepared in a manner similar to the airlay process described in U.S. Pat. No. 3,765,971.

A nonwoven fabric is prepared by using the adherent polymer of the present invention as the binding agent for a nonwoven web of shoddy, reclaimed, fibers. The binder is present in an amount of 20 weight percent and the shoddy fiber is present in an amount of 80 weight percent, both weights based on the total weight of the resultant batt. A nonwoven web is obtained in which the fibers are relatively firmly bonded together by the bonding agent.

As stated above, the fibrous web is prepared using shoddy fibers. The shoddy fibers used in this example consist primarily of cotton and polyester fibers. Because of the source of the fibers, it is difficult to obtain an exact compositional breakdown, but the proportion of fibers is estimated to be about 60% polyester, about 40% cotton, and up to 1% acrylics. The length of fibers used is generally between about 1–2 inches.

The adherent polymers used in this example is a copolymer of vinylidene chloride and methylacrylate in a weight ratio of 91.8 to 8.2. The copolymer has a melting temperature of about 150° C., a weight average molecular weight of 85,000, and a particle diameter of 30 microns.

The web is rolled into a bale and stored for a time. The web is eventually unrolled and used to make mattress padding. The web, after fabrication into mattress padding, is characterized by excellent softness and tensile strength.

EXAMPLE 6

A nonwoven web is prepared in a manner similar to the garnetting process described in U.S. Pat. No. 4,051,294.

A nonwoven fabric is prepared by using the adherent polymer of the present invention as the binding agent for a nonwoven web of shoddy, reclaimed, fibers. The binder is present in an amount of 20 weight percent and the shoddy fiber is present in in an amount of 80 weight percent, both weights based on the total weight of the resultant batt. A nonwoven web is obtained in which the fibers are relatively firmly bonded together by the bonding agent.

As stated above, the fibrous web is prepared using shoddy fibers. The shoddy fibers used in this example consist primarily of cotton and polyester fibers. Because of the source of the fibers, it is difficult to obtain an exact compositional breakdown, but the proportion of fibers is estimated to be about 60% polyester, about 40% cotton, and up to 1% acrylics. The length of fibers used is generally between about 1–2 inches.

The adherent polymer used in this example is a copolymer of vinylidene chloride and methylacrylate in a weight ratio of 91.8 to 8.2. The copolymer has a melting temperature of about 150° C., a weight average molecular weight of 85,000, and a particle diameter of 30 microns.

The web is rolled into a bale and stored for a time. The web is eventually unrolled and used to make mattress padding. The web, after fabrication into mattress padding, is characterized by excellent softness and tensile strength.

Although the invention has been described in considerable detail, with reference to certain preferred embodiments thereof, it will be understood that variations and modifications can be effected within the spirit and scope of the invention as described above and as defined in the appended claims.

What is claimed is:

1. A fibrous batt comprising:

(a) individual fibers and an at least partially melted and resolidified bonding agent, wherein the fibers are present in an amount of from about 1 to about 95 percent by weight of batt and the bonding agent is present in an amount of from about 99 to about 5 percent by weight of batt;

(b) said fibers being bonded at their intersection by melted particles of a bonding agent;

(c) said bonding agent comprising (i) a vinylidene chloride interpolymer, the interpolymer being formed from a monomer mixture comprising vinylidene chloride in an amount of from about 70 to about 98 percent, based on total weight of monomer mixture, and (ii) at least one monoethylenically unsaturated monomer copolymerizable therewith in an amount of from about 30 to about 2 percent, based on total weight of monomer mixture, wherein the monoethylenically unsaturated monomer is selected from the group consisting of alkyl acrylates or alkyl methacrylates.

2. The fibrous batt of claim 1 wherein the alkyl acrylates an alkyl methacrylates have from about 1 to about 8 carbon atoms per alkyl group.

3. The fibrous batt of claim 2 wherein the alkyl acrylates and alkyl methacrylates have from about 1 to about 4 carbon atoms per alkyl group.

4. The fibrous batt of claim 3 wherein the alkyl acrylates and alkyl methacrylates are selected from the group consisting of methyl acrylate, ethyl acrylate, methyl methacrylate, n-butyl acrylate, isobutyl acrylate, sec-butyl acrylate, and 2-ethylhexyl acrylate.

5. The fibrous batt of claim 3 wherein the alkyl acrylates and alkyl methacrylates are selected from the group consisting of methyl acrylate, ethyl acrylate, and methyl methacrylate.

6. The fibrous batt of claim 1 wherein the amount of alkyl acrylate is from about 15 to about 3 percent by weight of interpolymer and the amount of vinylidene chloride is from about 85 to about 97 percent by weight of interpolymer.

7. The fibrous batt of claim 6 wherein the amount of alkyl acrylate is from about 10 to about 4 percent by weight of interpolymer and the amount of vinylidene chloride is from about 90 to about 96 percent by weight of interpolymer.

8. The fibrous batt of claim 1 wherein the fibers are present in an amount of from about 50 to about 92 percent by weight of batt and the bonding agent is present in an amount of from about 50 to about 8 percent by weight of batt.

9. The fibrous batt of claim 8 wherein the fibers are present in an amount of from about 70 to about 89 percent by weight of batt and the bonding agent is present in an amount of from about 30 to about 11 percent by weight of batt.

10. A fibrous batt comprising:

(a) individual fibers and an melted bonding agent, wherein the fibers are present in an amount of from about 1 to about 95 percent by weight of batt and the bonding agent is present in an amount of from about 99 to about 5 percent by weight of batt;

(b) said fibers being bonded at their intersection by melted particles of a bonding agent;

(c) said bonding agent comprising (i) a vinylidene chloride interpolymer, the interpolymer being formed from a monomer mixture comprising vinylidene chloride in an amount of from about 70 to about 98 percent, based on total weight of monomer mixture, and (ii) at least one monoethylenically unsaturated monomer copolymerizable therewith in an amount of from about 30 to about 2 percent, based on total weight of monomer mixture, wherein the monoethylenically unsaturated monomer is selected from the group consisting of alkyl acrylates or alkyl methacrylates.

* * * * *

UNITED STATES PATENT AND TRADEMARK OFFICE

CERTIFICATE OF CORRECTION

PATENT NO. : 4,869,950

DATED : Sep. 26, 1989

INVENTOR(S) : Jeffrey M. Elsen; Martin F. Debney; Thomas J. Kling

It is certified that error appears in the above-identified patent and that said Letters Patent is hereby corrected as shown below:

Col. 1, last line, "lost" should read --loft--.
Col. 3, line 11, "are" should read --and--; and line 21, "copolymer" should read --copolymers--.
Col. 4, line 32, "100°C" should read --110°C--.
Col. 5, line 27, "VCD-VC" should read --VDC-VC--.
Col. 7, line 56, "the" should read --The--.

Signed and Sealed this

Second Day of October, 1990

*Attest:*

*Attesting Officer*

HARRY F. MANBECK, JR.

*Commissioner of Patents and Trademarks*